US005586959A

United States Patent [19]

Adkins et al.

[11] Patent Number: 5,586,959

[45] Date of Patent: Dec. 24, 1996

[54] EXERCISE MACHINE

[76] Inventors: Joseph E. Adkins, P.O. Box 7758, Huntington, W. Va. 25776; Jeffrey A. Adkins, 174 Iroquois Trail, Ona, W. Va. 25545

[21] Appl. No.: 575,548

[22] Filed: Dec. 20, 1995

[51] Int. Cl.[6] ..... A63B 21/00

[52] U.S. Cl. ..... 482/96; 482/95; 482/72

[58] Field of Search ..... 482/51, 95, 72, 482/96, 57, 923, 137, 130, 111; 472/106, 110, 120

[56] References Cited

U.S. PATENT DOCUMENTS

| | | |
|---|---|---|
| D. 356,112 | 2/1994 | Smith et al. . |
| D. 356,128 | 3/1995 | Smith et al. . |
| 2,455,548 | 7/1948 | Bell . |
| 2,642,288 | 8/1949 | Bell . |
| 2,924,456 | 11/1957 | Miller . |
| 4,300,760 | 11/1981 | Bobroff . |
| 5,029,848 | 7/1991 | Sleamaker . |
| 5,299,997 | 4/1994 | Chen . |
| 5,342,269 | 8/1994 | Huang et al. . |
| 5,356,357 | 10/1994 | Wang et al. . |
| 5,366,428 | 11/1994 | Liao . |
| 5,421,795 | 6/1995 | Chen . |

FOREIGN PATENT DOCUMENTS

| | | |
|---|---|---|
| 474691 | 6/1951 | Canada . |
| 92/18204 | 10/1992 | WIPO . |

*Primary Examiner*—Jerome Donnelly
*Attorney, Agent, or Firm*—Richard C. Litman

[57] ABSTRACT

An exercise machine of the horse-type on which a user is seated and glides generally horizontally in a reciprocal motion. The present invention comprises a support frame, a seat assembly, a unitary handlebar/footrest assembly, and a glide assembly. The glide assembly is pivotally and operably linked to the seat assembly by a seat riser arm, which in turn is pivotally and operably linked to the handlebar/footrest assembly by a linkage bar. The frame includes generally a rear vertical support fixedly extending upwardly and perpendicularly from a rear base foot, a longitudinal rail assembly upon which the glide assembly reciprocally moves and further includes a front vertical support fixedly extending upwardly and perpendicularly from a front base foot. The front vertical support allows the pivotal attachment of the handlebar/footrest assembly forward of the vertical leg support. The glide assembly is equipped with a frictional means by which added resistance may be variably applied.

8 Claims, 6 Drawing Sheets

EXERCISE MACHINE

BACKGROUND OF THE INVENTION

1. Field of the Invention

The present invention relates to an exercise machine of the horse-type on which a user is seated and glides generally horizontally in a reciprocal motion.

2. Description of the Prior Art

The prior art describes numerous exercise devices showing a horse-type exercise device including common elements such as a frame, a seat, handlebars, foot pedals, and a glide mechanism beneath the seat. Patents exemplary of such a horse-type exercise device design include U.S. Pat. No. 356,128 issued Mar. 7, 1995 to Smith and U.S. Pat. No. 344,112 issued Feb. 8, 1994 to Smith. Accordingly, the general overall appearance of a horse-type exercise device is known.

The patents discussed below also all disclose an exercise device including common elements such as a base frame, a seat, handlebars, foot pedals, and pivoting mechanisms. However, significant differences in utility exist between the various devices found in the prior art. For example, WIPO Pat. Application No. 92/18204 by Lambert published Oct. 29, 1992 describes a horse-type exercise machine in which a horizontal gliding motion is allowed by a handle bar assembly and pedal assembly structurally independent of each other but pivotally connected and being mechanically linked to a guiding mechanism riding a horizontal bar The guiding mechanism is a wheel strut to which a freely rotating wheel, not provided with a resistance or braking mechanism, is attached.

In contrast, U.S. Pat. No. 2,455,548 issued Jul. 22, 1948 to Bell, also disclosed in Canadian Patent No. 474,691 issued Jun. 26, 1951, shows a similar horse-type exerciser using a wheel and wheel strut; however, the wheel strut is eccentrically connected to a fly-wheel assembly. The assembly serves to smooth out the movement of the wheel on a wave-like track (designed for generating momentum before reciprocal motion occurs) and also fails to provide a resistance mechanism by which the wheel can be braked. Moreover, the handlebar assembly is immobilely attached to the frame. U.S. Pat. No. 2,642,288 issued Aug. 1, 1949, also to Bell, shows a similar invention in which the fly-wheel mechanism has been removed and a stop mechanism has been added. The distinguishable differences in the means by which the exercise devices function between the Bell patents and Lambert patent are, therefore, slight.

Likewise, U.S. Pat. No. 4,300,760 issued Nov. 17, 1981 to Bobroff describes a horse-type exercise machine, also pivotally linking the handle bar assembly and foot pedal assembly so that as the seat and the foot pedal assembly glide forward, the handle bar assembly pivots rearwardly. Although structurally the linkages described in the Bobroff and Bell '288 patent appear very similar, the Bobroff patent alleges simplified function.

U.S. Pat. No. 5,299,997 issued Apr. 5, 1994 to Chen describes an even simpler device pivotal at three points allowing a following member to reciprocate as guided between a pair of base frame rails. U.S. Pat. No. 5,421,795 issued Jun. 6, 1995 to Chen simplifies over the '997 Chen patent, including only two pivotal points and following member. Both Chen patents show the following member unified with the handlebar, and pivotally linked with independent foot pedal assembly.

U.S. Pat. No. 2,924,456 issued Feb. 9, 1960 to Miller discloses an improvement for a horse-type exercise machine comprising a stop means to limit pivotal movement of a handle pivoted to the frame. U.S. Pat. No. 5,029,848 issued Jul. 9, 1991 to Sleamaker is an exercise machine with a seat supporting roller carriage mounted on a monorail to accurately simulate skiing techniques.

U.S. Pat. No. 5,342,269 issued Aug. 30, 1994 to Huang et al. is an exercise machine in which the seat and handlebar assemblies are linked, but which fails to ride on a monorail or have gliding means, and has immobilely attached foot rests. U.S. Pat. No. 5,356,357 issued Oct. 18, 1994 to Wang et al. describes a similarly structured invention. U.S. Pat. No. 5,366,428 issued Nov. 22, 1994 to Liao has a foot pedal assembly which pivots, however its linkage assembly significantly differs from the prior art.

None of the above inventions and patents, taken either singly or in combination, is seen to describe the instant invention as claimed.

SUMMARY OF THE INVENTION

The present invention relates to an exercise machine of the horse-type on which a user is seated and glides generally horizontally in a reciprocal motion. The present invention comprises a support frame, a seat assembly, a unitary handlebar/footrest assembly, and a glide assembly. The glide assembly is pivotally and operably linked to the seat assembly by a seat riser arm, which in turn is pivotally and operably linked to the handlebar/footrest assembly by a linkage bar. The frame includes generally a rear vertical support fixedly extending upwardly and perpendicularly from a rear base foot, a longitudinal rail assembly upon which the glide assembly reciprocally moves and further includes a front vertical support fixedly extending upwardly and perpendicularly from a front base foot. The front vertical support allows the pivotal attachment of the handlebar/footrest assembly forward of the vertical leg support.

In operation, the user sits on the seat assembly, grasps a handlebar of the handlebar/footrest assembly with both hands and places each foot on an associated footrest. To begin exercising, the user pivots the handlebar by pulling rearward and simultaneously pushes the footrest forward from a first position to a second position. As the assemblies are pivoted to the second position, the seat assembly causes the seat to rise by the seat riser arm as the glide assembly slides forward along the length of the rail assembly. At maximum extension of the handlebar/footrest assembly at the second position, the user reverses direction, returning the handlebar/footrest assembly to the first position, in turn lowering the seat support as the seat riser arm slides the glide assembly along the length of the rail assembly rearwardly. During repetition of the described motions, the user's weight provides the principal source of resistance to the exercise routine performed by the user on the exercise machine. However, the glide assembly is equipped with a frictional means by which added resistance may be variably applied.

Accordingly, it is a principal object of the invention to provide an exercise machine of the horse-riding type which operates by pushing and pulling while seated.

It is another object of the invention to provide a horse-type exercise machine having a unitary handlebar/footrest assembly which may be linked to a glide assembly.

It is a further object of the invention to provide a horse-type exercise machine having a glide assembly.

Still another object of the invention is to provide a horse-type exercise machine having a glide assembly with a variable resistance mechanism.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
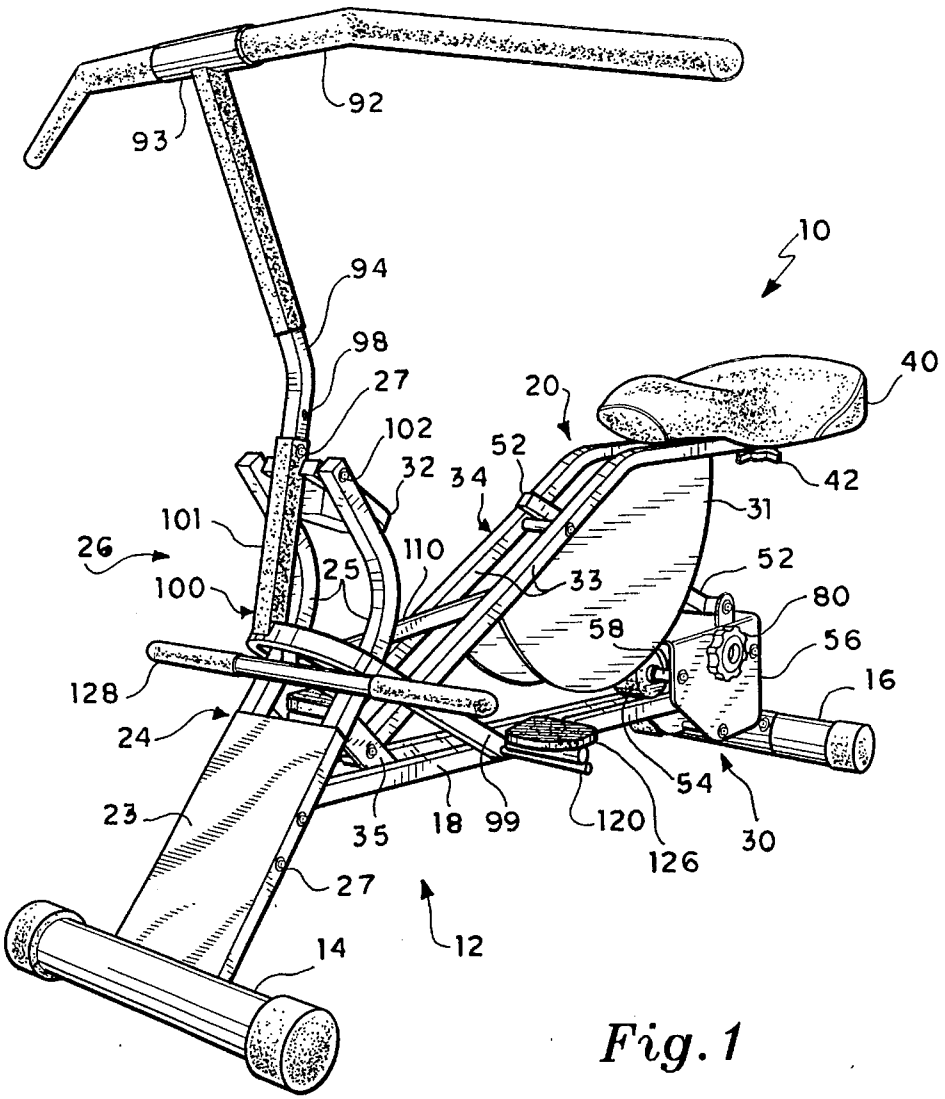
FIG. 1 is a perspective view of the exercise machine.
Figure 2:
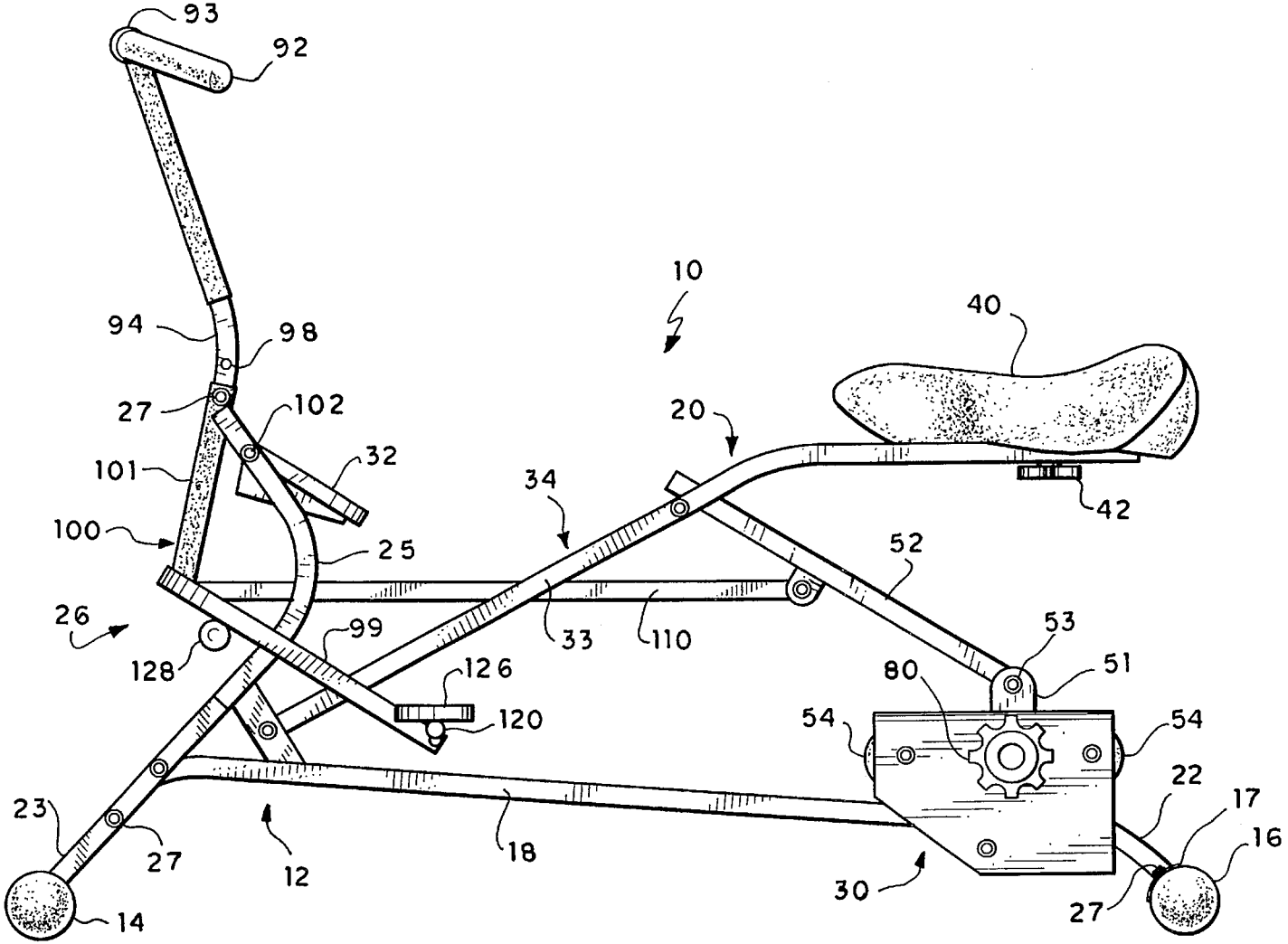
FIG. 2 is a side elevational view of the exercise machine in a resting position.
Figure 3:
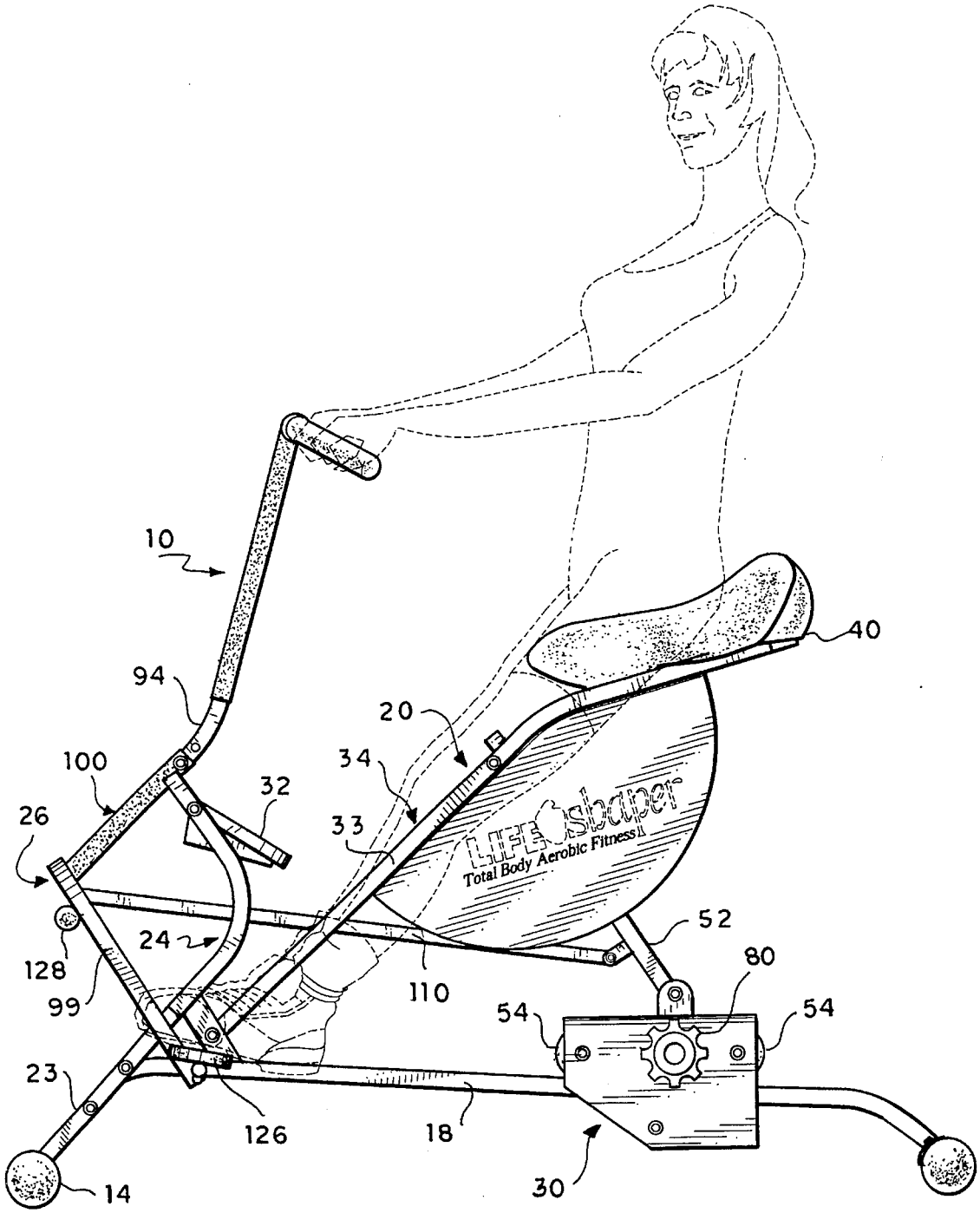
FIG. 3 is a side elevational view of the exercise machine in use in an extended position.
Figure 4:
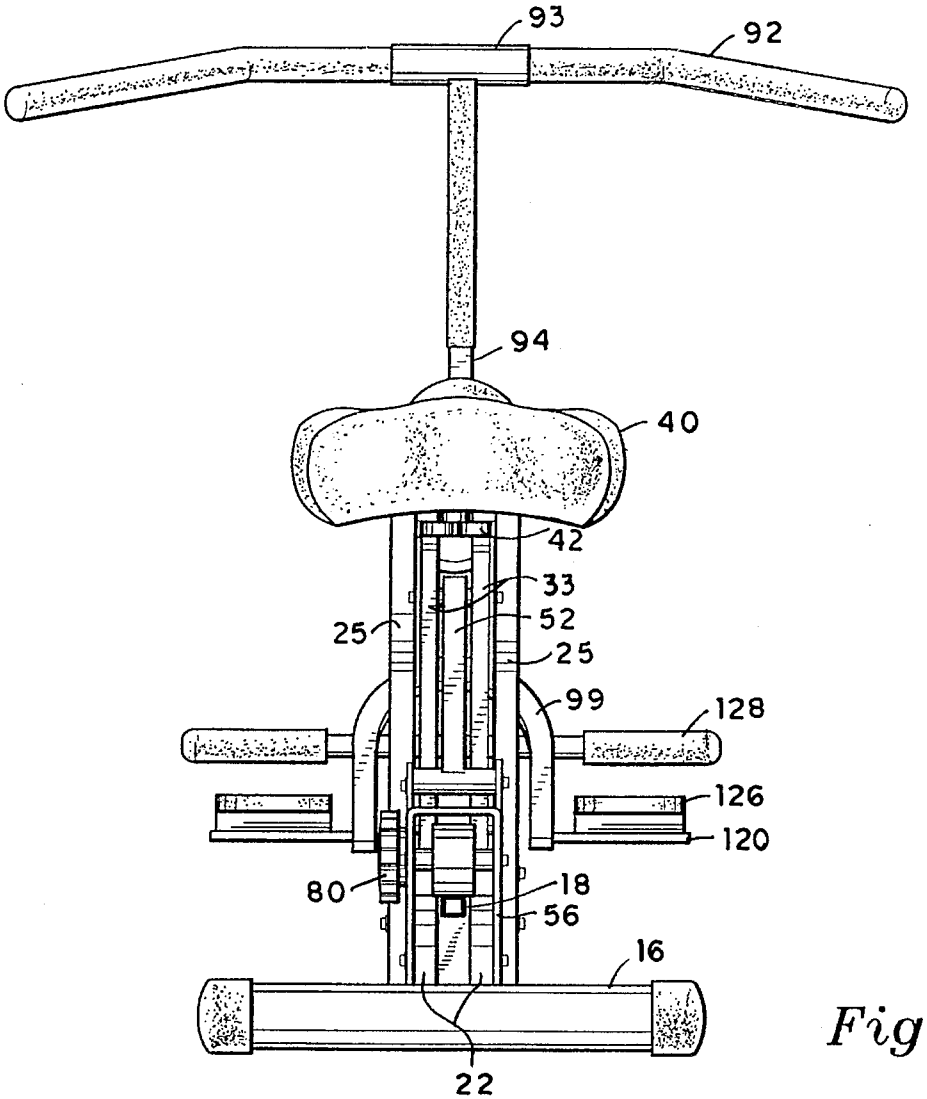
FIG. 4 is a rear view of the exercise machine.
Figure 5:
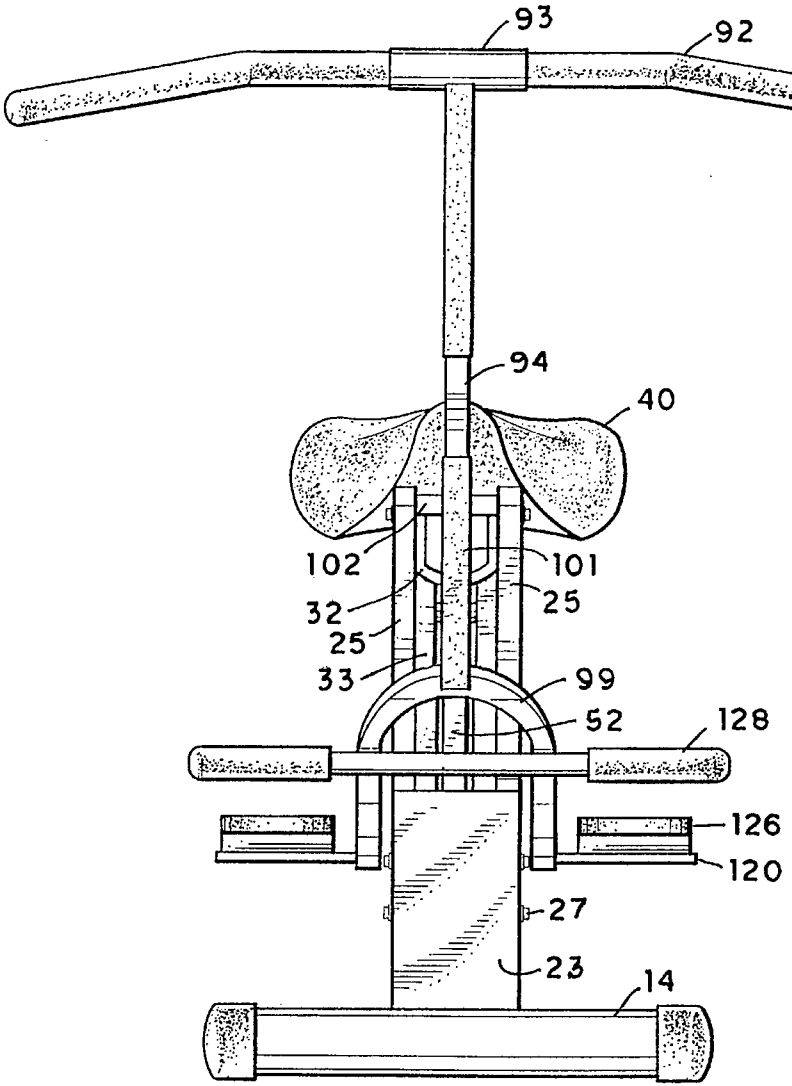
FIG. 5 is a front view of the exercise machine.
Figure 6:
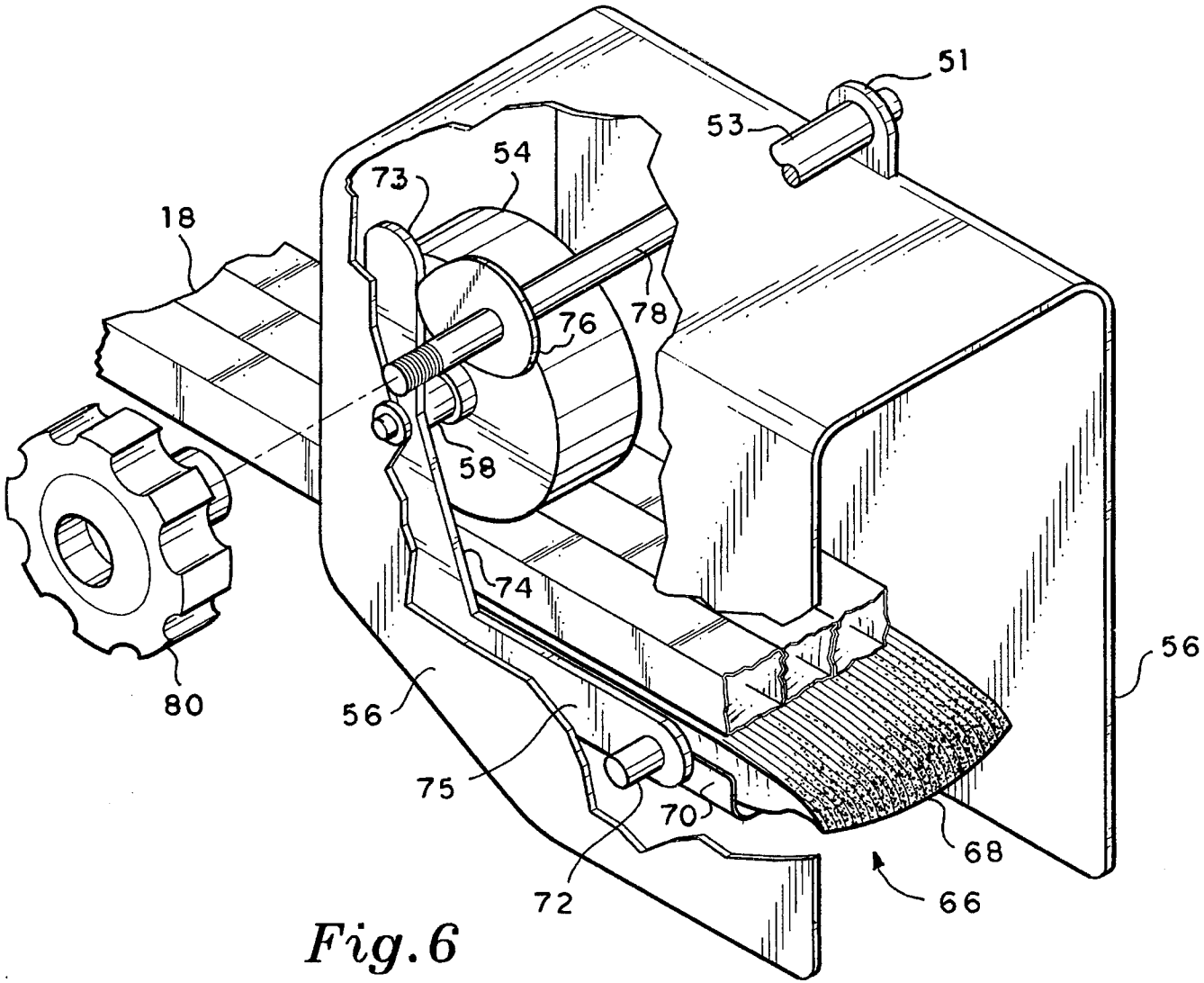
FIG. 6 is a partially exploded and partially fragmented view of the gliding mechanism of the exercise machine.

The present invention relates to an exercise machine of the horse-type on which a user is seated and glides generally vertically and horizontally in a reciprocal motion. Referring primarily to FIG. 1 and FIG. 2, a horse-type exercise machine 10 in accordance with the present invention in a first, resting position is shown, including a support frame 12, a seat assembly 20, a handlebar/footrest assembly 26, and a glide assembly 30 being pivotally and operably attached to the support frame, seat assembly and handlebar/footrest assembly. Additional FIGS. 4 and 5, showing a rear and front view of the exercise machine 10, are shown only for clarity and comparison of views of each of the enumerated parts and will not be referred to specifically. FIG. 3 shows the exercise machine in a second position to help describe its operation and intended use. FIG. 6 shows the internal operating mechanisms of the glide assembly 30, including a variable resistance means.

Referring first to FIG. 1 and FIG. 2, the frame 12 includes generally a rear vertical support 22 fixedly extending upwardly from a rear base foot 16, a longitudinal rail assembly 18, and a front vertical support 24 fixedly extending upwardly and perpendicularly from a front base foot 14. Although the rail assembly in the preferred embodiment is comprised of three individual tubes permanently affixed to one another (as can be best appreciated in FIG. 6), a monorail or other such guide bar could be substituted.

The front vertical support 24 further comprises a plate 23 and a pair of support tubes 25, removably attached to one another by fasteners 27 passing through registered openings defined in the plate 23 and support tubes 25. The front base foot 14 and the rear base foot 16 provide support and lateral stability to the frame 12; the removable fasteners 27 allow the front vertical support 24 to be disassembled into separate components for ease of transport and storage of the exercise machine 10.

The rail assembly 18 is an elongated rigid member oriented generally perpendicularly to the front vertical support 24 and the rear vertical support 22 such that the gliding assembly 30 is able to be slidably guided in a reciprocal motion over the rail assembly 18. The rear vertical support 22 is integrally formed by a bend in the rail assembly 18. The rear base foot 16 is removably attached to the rail assembly 18 nearest the bend by means of removable fasteners 27 passing through the registered openings 28 being defined in the rear base foot 16 and an arcuate plate 17 fixedly attached to the terminus of rail assembly 18. The opposite terminus of the rail assembly 18 is fixedly attached to the front vertical support 24 between each of the pair of support tubes 25. The support tubes 24 extend in a parallel manner a predetermined height above the rail assembly 18 to provide an pivot point for attachment of the handlebar/footrest assembly 26 and for fixed attachment of a display stand 32. The stand 32 is intended to accommodate a timer or other exercise monitoring devices such as, a pulse monitor, a calorie expenditure counter, or exercise repetition counter.

The handlebar/footrest assembly 26 includes a tubular handlebar 92, an upper handlebar rod 94, and a lower pitchfork member 100 for support of foot pedals 126 and footrest bar 128 Beginning at the uppermost portion of this assembly, the handlebar 92 is dimensioned and configured to matingly engage a tubular socket 93, which is centrally attached to the top end of the handlebar rod 94 and oriented perpendicularly to both the handlebar rod 94 and the rail assembly 18. The opposing end of the handlebar rod 94 is dimensioned and configured to matingly engage the pitchfork member 100, having a handlebar rod receiving member 101 and a U-shaped member 99 fixedly attached to the receiving member 101 at its midpoint (the base of the "U"). The pitchfork member 100 includes means by which the handlebar rod can be adjusted to accommodate different height users of the exercise machine, including a removable fastener 27 passing through a pair of plurality of holes 98 along the longitudinal axis of the handlebar rod 94 in registry with a plurality of holes 98 in the receiving member 101. By removing the fastener, the handlebar rod 94 may be extended vertically until a different pair of holes 98 align and the fastener 27 may be reinserted to secure the relative position of the two components to each other. At the juncture of the U-shaped member 99 and the receiving member 101, the footrest bar 128 is fixedly attached in perpendicular relation to both the receiving member 101 and the rail assembly 18. At the terminus of each of the prongs of the U-shaped member 99, a foot pedal 126 is attached by means of two pedal supports 120. Preferably, the pedal supports 120 are pivotally connected.

A pivot pin assembly 102 pivotally and operably connects the handlebar/footrest assembly 26 to the terminal portion of the support tubes 25 of the front vertical support 24 of the frame 12. The pin assembly 102 provides support for the handlebar/footrest assembly 26 as well as permits the handlebar rod 94 to pivot in a reciprocal forward/rearward motion relative to the front vertical support 24.

A seat support 34, comprising two parallel beams 33 and an ornamental skirt 31, is pivotally attached to a bridging member 35 fixedly attached between the rail assembly 18 near its front terminus and the front vertical support 24. The seat support 34 provides an upper section oriented at an angle relative to a lower section for supporting a seat 40 positioned thereon. Preferably, the seat 40 is adjustable along the length of the upper section, for example by means of a manually operated set screw 42.

The glide assembly 30 is connected to the seat support 34 via a seat riser arm 52 by means capable of pivotal motion, such as a pair of apertured projections 51 and mating locking pin 53. The glide assembly 30 includes a plurality of wheels 54 connected together by a support housing 56, preferably having parallel sides and a top cross member. As can be best appreciated from FIG. 6, each one of the plurality of wheels 54 receive a centrally positioned axle 58 which extends between and attaches to the pair of parallel sides of the support housing 56 to allow rotating motion of each wheel 54. Preferably, the plurality of wheels 54 includes two upper wheels 54 positioned to engage the upper surface of the rail assembly 18. The support housing 56 further supports a lower friction pad assembly 66 which is centrally located beneath the two upper wheels 54 and rail assembly 18.

Referring to the structure and function of the friction pad assembly 66 in FIG. 6, the preferred embodiment of the exercise machine 10 provides a pad 68 capable of frictionally engaging the lower surface of the rail assembly 18. The pad 68 is supported by a tray 70 having a trunnion 72 on which the tray 70 may pivot to bring the pad 68 into generally parallel relation with the underside of the rail assembly 18. The tray 70 is operably linked to a horizontal member 75 of a generally L-shaped pressuring arm 74 pivotally seated on the axle 58 of wheel 54. The pivot point is located centrally between upper and lower ends of a vertical member 73 of the pressuring arm 74. That portion of the vertical member 73 above the pivot point and axle 58 is placed in contact with a rotatable cam 76 so that the vertical member 73 remains in contact through a full rotation of the cam 76. The cam 76 is supported and affixed to a rotatable shaft 78 passing through the parallel sides of the support housing 56 so as to allow the cam to rotated. This shaft 78 terminates on the outside of the support housing 56 with a removably attached adjustment knob 80 for convenient manual rotation of the cam 76. Thus, when the cam is rotated to maximally extended position as shown in FIG. 6, the pressuring arm 74 is in a position which maximally acts as a lever against the tray 70 and pad 68 and forces the pad 68 against the rail assembly 18, thereby increasing the resistance against the movement of glide assembly 30 along the length of the rail assembly 18. It should be understood that the resistance provided by the frictional pad assembly may be controlled by automated as well as manual means.

Referring back to FIG. 1 and FIG. 2, the seat riser arm 52 is pivotally connected by its lower terminus to the glide assembly 30. The upper terminus of the seat riser arm 52 is pivotally connected to a point between each end of the seat support 34. When the seat support 34 is in a first position (as shown each of FIGS. 1, 2, 4 and 5), the seat riser arm 52 is oriented at an acute angle relative to the rail assembly 18 and the seat 40 is generally parallel with the rail assembly 18. When the seat support 34 is in the second position (as shown in FIG. 3), the seat riser arm 52 is oriented at an angle which is substantially less acute and the seat 40 is also oriented at an acute angle relative to the rail assembly 18.

A linkage bar 110 connects the seat riser arm 52 to the handlebar/footrest assembly 26. The linkage bar 110 is pivotally connected at its front end to the pitchfork member 100 and at the other end to the seat riser arm 52. The handlebar/footrest assembly 26 is pivotable by the user between a first position, in which the handlebar 92 is distal to the seat 40 and the foot pedals 126 are proximate, and a second position, in which the handlebar 92 is proximate to the seat 40 and the pedals 126 are distal. The exercise machine 10 is configured such that when the handlebar 92 is in the first position, the seat support 34 is also in the first position. Conversely, when the handlebar 92 is pivoted to the second position, the seat support 34 is also in the second position.

Thus, it can be observed by comparing FIG. 2 and FIG. 3, that, by pivoting of the handlebar/footrest assembly 26 between the first position and the second position, the linkage bar 110 causes the seat riser arm 52 to be moved in a reciprocal motion, which in turn causes the glide assembly 30 to glide along the length of the rail assembly 18 and the seat support 34 to be raised and lowered.

In operation and as can be appreciated from FIG. 3, the user sits on seat 40, grasps the handlebar 92 with both hands, and places both feet on either the foot pedals 126 or the footrest bar 128. The exercise machine 10 may then be adjusted to accommodate the correct height of a users by adjusting the handlebar rod 94 relative to the front vertical supports 24 and by adjusting the seat 40 relative to the seat support 34 using the set screw 42.

To begin exercising, the user pivots the handlebar/footrest assembly 26 from the first position to the second position. As the handlebar/footrest assembly 26 is pivoted to the second position, the seat support 34 is raised to the second position and the seat riser arm 52 acts to slide the glide assembly 30 along the length of the rail assembly 18. Once the handlebar/footrest assembly 26 reaches the second position, the user reverses direction, and returns to the first position. Between the second and the first positions, the seat support 34 is lowered to the first position and the seat riser arm 52 acts to slide the glide assembly 30 along the length of the rail assembly 18 in the reverse direction.

One such repetition comprises an exercise unit, which is repeated indefinitely to exercise muscles of the arms and legs simultaneously and other body areas. It should become apparent to one skilled in the art that the user's weight provides the principal source of resistance to the exercise routine performed by the user on the exercise machine 10. By applying frictional resistance by means of the frictional pad assembly 66, additional resistance may be provided against which the body muscles exercise.

It is to be understood that the present invention is not limited to the sole embodiment described above, but encompasses an and all embodiments within the scope of the following claims.

We claim:

1. An exercise machine comprising:

a frame including an elongated base and a front vertical member extending upwardly from said base, said elongated base including a longitudinal rail having an upper surface and a lower surface;

a unitary handlebar and footrest assembly having an upper end and a lower end, said handlebar and footrest assembly including a handlebar attached at said upper end and at least one footrest disposed on each side of said elongated base and attached to said lower end, said handlebar and footrest assembly being pivotally attached to said front vertical member at a point between said upper end and said lower end;

a seat assembly including an elongated seat support member having a proximate end and a distal end, said proximate end being pivotally attached to said base and said distal end providing an area for support of a user;

a glide assembly for reciprocal motion along said elongated base, said glide assembly including a wheel riding on the upper surface of said longitudinal rail of said base and frictional means for adjusting frictional resistance to motion of said glide assembly along said longitudinal rail, said frictional means engaging the lower surface of said longitudinal rail;

a seat riser arm having a first end and a second end, said first end being pivotally attached to said seat support member at a point between said distal end and said proximate end and said second end being pivotally attached to said glide assembly; and a linkage bar having a front end and a rear end, said front end being pivotally attached to said handlebar and footrest assembly at a point between said upper end and said lower end and said rear end being pivotally attached to said seat riser arm at a point between said first end and said second end.

2. The exercise machine according to claim 1, wherein said glide assembly includes a support housing from which said frictional means are provided, said frictional means including a pad dimensioned and configured to be capable of frictionally engaging said base and operably engaging a pressuring means for selectively providing pressure against said pad and further adapted so that said pad is allowed to glide along said base while adding resistance against such gliding movement.

3. The exercise machine according to claim 2, wherein said pressuring mean further includes a pressuring arm dimensioned and configured to be in contact with said pad and capable of applying pressure to said pad and further being pivotally attached to said support housing, and further including a cam operable affixed to a shaft capable of selective rotation of said cam to one of a plurality of fixed positions wherein said cam is in contact with said pressuring arm, whereby said cam causes said pressure arm to exert pressure against said pad.

4. The exercise machine according to claim 1, wherein said unitary handlebar and footrest assembly further comprises a handlebar and handlebar rod being attached to one another and further comprising a pitchfork member, having a U-shaped member integrally connected with a handlebar rod receiving member, said handlebar rod and said handlebar rod receiving member being matingly and removably engaged whereby a disassemblable, unitary assembly is formed.

5. The exercise machine according to claim 1, wherein said glide assembly includes a support housing from which said frictional means are provided, said frictional means including a pad dimensioned and configured to be capable of frictionally engaging said lower surface of said rail and operably engaging a pressuring means for providing variable pressure against said pad and further adapted so that said pad is allowed to glide along said lower surface while adding resistance against such gliding movement.

6. An exercise machine comprising:

a support frame including a longitudinal rail;

a handlebar and footrest assembly pivotally attached to said support frame;

a seat assembly including an elongated seat support member and a seat, said seat support member having a proximate end and a distal end, said proximate end pivotally attached to said support frame, said seat attached to said distal end of said seat support member;

a seat riser arm having a first end and a second end, said first end pivotally attached to said seat support member;

a glide assembly attached to said second end of said seat riser arm, said glide assembly riding on said longitudinal rail of said support frame;

adjustable friction means for controlling resistance to motion of said glide assembly along said longitudinal rail; and a linkage bar having a front end and a rear end, said front end pivotally attached to said handlebar and footrest assembly and said rear end pivotally attached to said seat riser arm.

7. The exercise machine according to claim 6 wherein said glide assembly includes a wheel riding on said longitudinal rail and said adjustable friction means includes a pad attached to said glide assembly, said pad pressing against said longitudinal rail.

8. The exercise machine according to claim 7 wherein said adjustable friction means further includes:

a pressuring arm having a first end and a second end, said pressuring arm pivotally attached to said glide assembly, said first end attached to said pad; and a rotatable cam in contact with said second end of said pressurizing arm; whereby rotation of said cam forces said pad against said longitudinal arm.

* * * * *